US005517788A

United States Patent [19]

McGough et al.

[11] Patent Number: 5,517,788

[45] Date of Patent: May 21, 1996

[54] ADJUSTABLE THRESHOLD ASSEMBLY WITH WATER-TIGHT SEAL

[75] Inventors: Harold R. McGough, Williamsburg; Haik Khanlarian, Richmond, both of Ind.

[73] Assignee: Imperial Products, Inc., Richmond, Ind.

[21] Appl. No.: 344,558

[22] Filed: Nov. 23, 1994

[51] Int. Cl.[6] ..... E06B 1/70

[52] U.S. Cl. ..... 49/468; 49/467

[58] Field of Search ..... 49/467, 468, 469, 49/482.1

[56] References Cited

U.S. PATENT DOCUMENTS

| | | | |
|---|---|---|---|
| D. 110,452 | 7/1937 | Baum . | |
| 3,402,512 | 9/1968 | Peterson | 49/468 |
| 3,762,100 | 10/1973 | Kempel | 49/468 |
| 3,900,967 | 8/1975 | Bursk et al. | 49/468 |
| 3,967,412 | 7/1976 | Governale . | |
| 4,074,464 | 2/1978 | McCay | 49/468 |
| 4,945,680 | 8/1990 | Giguere . | |
| 5,010,690 | 4/1991 | Geoffrey . | |
| 5,136,814 | 8/1992 | Headrick | 49/468 |
| 5,179,804 | 1/1993 | Young | 49/468 X |
| 5,230,181 | 7/1993 | Geoffrey et al. . | |

*Primary Examiner*—Jerry Redman

*Attorney, Agent, or Firm*—Jacox, Meckstroth & Jenkins

[57] ABSTRACT

An extruded aluminum sill member is supported by and attached to a wood base member which also supports a longitudinally extending inner wood trim member. The sill, base and trim members define a longitudinally extending cavity which receives a vertically adjustable rail member. The rail member has longitudinally spaced captive screws which are threaded into inverted T-nuts confined within laterally extending slots formed within the wood base member, and the trim member covers the slots. The sill member also extends under a jamb or mullion and a fixed side panel, and a snap-in extruded plastic cap covers the cavity under the panel and has an upwardly projecting and inwardly curved flange with a flexible lip for engaging the outer surface of the panel to form a water-tight seal.

8 Claims, 1 Drawing Sheet

ADJUSTABLE THRESHOLD ASSEMBLY WITH WATER-TIGHT SEAL

BACKGROUND OF THE INVENTION

This invention relates to adjustable threshold assemblies of the general type disclosed in U.S. Pat. Nos. 5,010,690 and 5,230,181 which issued to the assignee of the present invention. In such an assembly, an elongated extruded aluminum sill member is supported by and attached to a wood base member, and a longitudinally extending wood trim member is attached to the inner edge of the base member. The sill, base and trim members cooperate to define a longitudinally extending cavity which receives a vertically adjustable rail member in the form of a wood or inverted extruded aluminum channel. The rail member carries longitudinally spaced captive screws which may be threaded into a portion of the aluminum sill member within the recess, as shown in the above patents. It is also known for the captive screws to be threaded into tubular T-nuts which are inserted into corresponding holes within the wood base member and flared at the bottom of the nuts, for example, as disclosed in U.S. Pat. No. 3,967,412.

Sometimes it is desirable for the threshold assembly to extend under a fixed jamb member or mullion and also under one or more side lites or panels, for example, as disclosed in Design U.S. Pat. No. 110,452 and U.S. Pat. No. 4,945,680. When one or more stationary or fixed side panels are used on one side or both sides of a moveable or pivotable door, sometimes separate aluminum sill members are used under the door and each side panel, and the mullion or jamb between the door and each side panel is used to cover the joint between the separate sill members. The sill member under the fixed side panel has also been provided with an upwardly projecting and integrally extruded aluminum flange which forms a corner seat for the fixed side panel. Caulking is used between the flange and the panel to form a water-tight seal.

When a single extruded aluminum sill member extends under the door and each side panel, it is known to use an extruded vinyl strip under the side panel. The vinyl strip is attached to the aluminum sill member and the supporting wood base member, and caulking is used between the bottom of the side panel and the vinyl strip to form a water-tight seal. It is a well known problem that most caulking materials become dry and hard after a period of time and develop cracks which destroy the seal provided by the caulking material.

SUMMARY OF THE INVENTION

The present invention is directed to an improved threshold assembly which is adapted to extend under a moveable door and also under a fixed side panel as well as under an intermediate jamb member or mullion. The threshold assembly provides for an adjustable rail under the moveable door and a positive and durable water-tight seal with the fixed side panel.

In accordance with one embodiment of the invention, an extruded aluminum sill member is attached to a wood supporting base member which also receives an inner wood nosing or trim member. The sill, base and trim members define a longitudinally extending cavity which receives a vertically adjustable rail member, and an extruded flexible plastic strip forms a water-tight seal between the sill and rail members while permitting the rail member to be adjusted. The rail member is supported by longitudinally spaced captive screws which are threaded into inverted T-nuts pressed into corresponding laterally extending mating slots within the wood base member. Under the fixed panel, the cavity for the rail member is covered by an extruded plastic cap which attaches to the sill member and includes an upwardly projecting and inwardly curved integral flange having an integral flexible lip seal for engaging the outer surface of the fixed panel.

Other features and advantages of the invention will be apparent from the following description, the accompanying drawing and the appended claims.

DESCRIPTION OF THE PREFERRED EMBODIMENT

Figure 1:
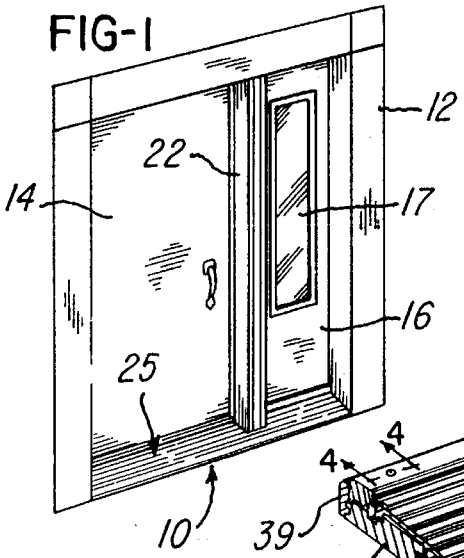
FIG. 1 is a perspective view of a threshold assembly constructed in accordance with the invention and shown installed under an entrance door and fixed side lite panel for a dwelling.
Figure 2:
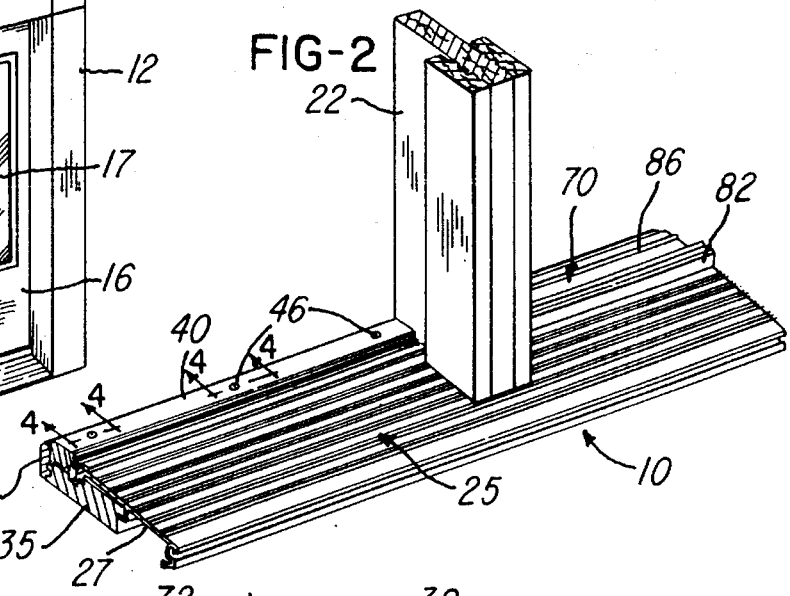
FIG. 2 is a fragmentary perspective view of the threshold assembly shown in FIG. 1.

Referring to FIG. 1, a threshold assembly 10 extends at the bottom of a rectangular frame 12 which supports a moveable or pivotable door 14 and a fixed panel 16 having a side lite 17. However, the fixed panel 16 may be any form of panel such as a fixed patio door. The frame 12 also includes a fixed vertical mullion or jamb 22 which seats or rests on the threshold 10 and supports weatherstripping (not shown) for contacting the moveable door 14 and fixed panel 16.

The threshold assembly 10 includes an extruded aluminum sill member 25 which has a cross section similar to that of the sill member disclosed in above mentioned U.S. Pat. No. 5,230,181. The sill member 25 includes a generally flat top wall 27, a downwardly projecting L-shaped flange 28 and an outer flange 29 which may also be used for attaching an extruded aluminum sill extension strip or member (not shown). The sill member 25 also includes a downwardly projecting U-shaped portion 32 which extends to an inner flange 34. A wood base member 35 is attached to the sill member 25 by a lip portion engaging the flange 28 and by fasteners (not shown) which secure the flange 34 to the base member 35 within a longitudinally extending cavity 37 within the wood base member 35.

A wood nosing or trim member 39 is attached to the inner edge surface of the wood base member 35, and an elongated wood rail member 40 extends within the cavity 37 between the trim member 39 and the U-shaped portion 32 of the sill member 25. A continuous flexible sealing strip 42 is extruded of a plastics or vinyl material and connects one edge of the rail member 40 to the U-shaped portion 32 of the sill member 25 in the same manner as disclosed in above mentioned U.S. Pat. No. 5,230,181.

Referring to FIGS. 2, 3, 4 and 6, the rail member 40 carries a series of longitudinally spaced adjustment screws 46 which provide for adjusting the rail member 40 vertically according to the position of the sweep seal (not shown) mounted on the bottom of the door 14. Each of the adjustment screws 46 includes a tapered head portion 48 with a Phillips recess 49 and which extends through a mating countersunk hole within the rail member 40. The head portion 48 is pressed onto a knurled upper end portion 52 of a threaded portion 54 having an outwardly projecting radial flange 56 located at the bottom of the rail member 40.

The lower threaded portion 54 of each adjustment screw 46 is threaded into a corresponding inverted tubular T-nut 58 having a non-circular rectangular bottom flange 59. Preferably each of the nuts 58 is die cast of a zinc alloy and is of the type produced, for example, by Stafast Products, Inc.

Figure 4:
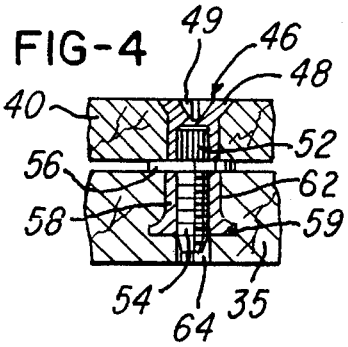
FIG. 4 is a fragmentary section taken generally on the line 4—4 of FIG. 3.
Figure 6:
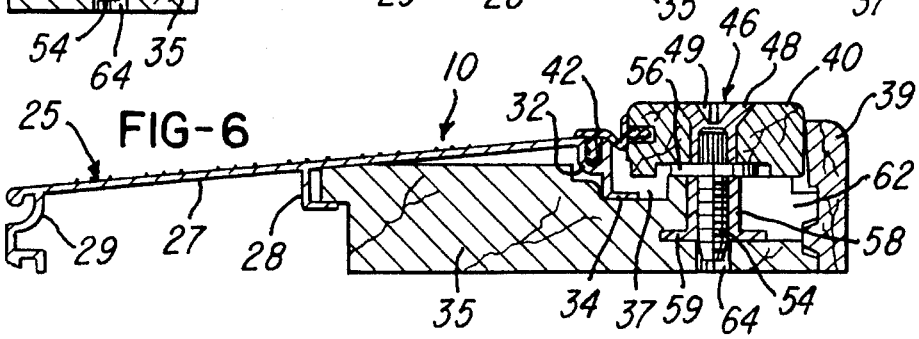
FIG. 6 is a section taken generally on the line 6—6 of FIG. 3.

As shown in FIGS. 4 and 6, each of the nuts 58 is pressed into a mating recess or slot 62 which extends laterally into the wood base member 35 and is formed by morticing with a router having the shape of a nut 58. The outer ends of the slots 62 are covered by the trim member 39. A hole 64 is formed within the base member 35 in alignment with each of the adjustment screws 46 for receiving the lower end of the threaded portion 54 of the screw when the rail member 40 is adjusted to its lowermost position (FIGS. 4 and 6). By capturing or confining each of the nuts 62 within a correspondingly shaped and laterally extending slot 62, each nut 62 is positively confined and prevented from rotating and moving axially within the base member 35 when the corresponding adjustment screw 46 is rotated to change the elevation of the rail member 40.

Figure 3:
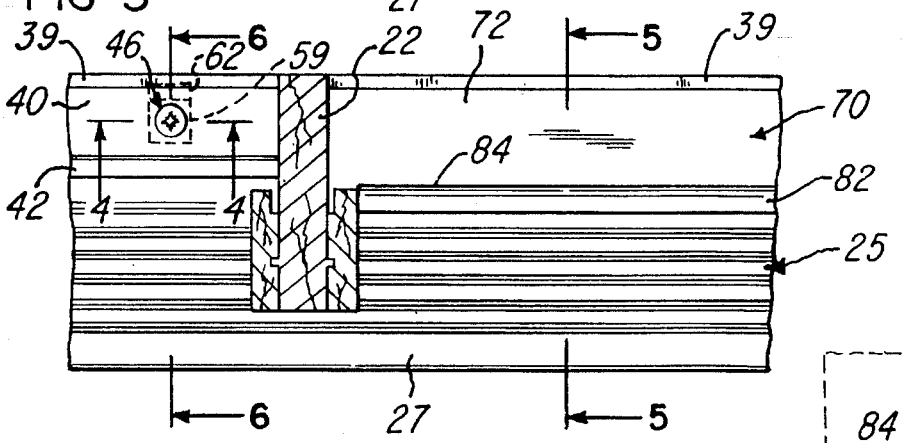
FIG. 3 is a fragmentary plan view of the threshold assembly shown in FIG. 2.
Figure 5:
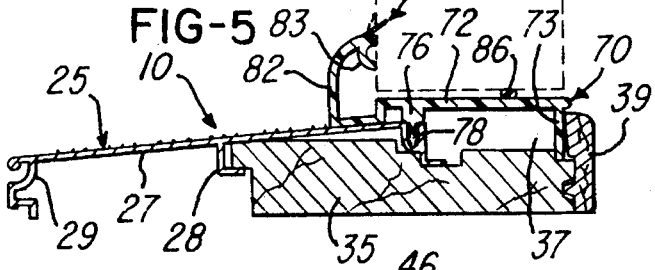
FIG. 5 is a section taken generally on the line 5—5 of FIG. 3.

Referring to FIGS. 3 and 5, and as mentioned above, the sill member 25 and base member 35 extend under the jamb 22 and also under the side panel 16. Directly under the side panel 16 and between the jamb 22 and frame 12, the cavity 37 within the base member 35 is covered and enclosed by an elongated cap member 70 which is extruded of a rigid plastics or vinyl material. The cap member 70 includes a flat top wall 72 and a downwardly projecting and longitudinally extending inner wall 73 which seats on the base member 35 adjacent the trim member 39. A longitudinally extending rib 76 also projects downwardly from the top wall 72 and seats on the U-shaped portion 32 of the sill member 25. A thinner rib 78 projects downwardly from the rib 76 and has outwardly projecting and longitudinally extending fins which are pressed into the U-shaped portion 32 for securing the cap member 70 to the sill member 25 and base member 35.

As shown in FIG. 5, the rigid plastic cap member 70 also includes an upwardly projecting and inwardly curved integral flange 82 which terminates with a semi-cylindrical portion 83 forming a front stop surface for the fixed panel 16. A flexible lip seal 84 is extruded as an integral part of the cap member 70 but with a lower durometer, and forms a water-tight seal with the outer surface of the panel 16. A bead 86 of caulking material is confined between the bottom surface of the panel 16 and the top wall 72 of the cap member 70.

From the drawing and the above description, it is apparent that a threshold assembly constructed in accordance with the present invention, provides desirable features and advantages. As one important feature, the cap member 70, with the upwardly projecting flange 82, provides a positive stop surface for the fixed panel 16, and the lip seal 84 provides a dependable water-tight seal between the flange 82 and panel 16. As another feature, the inverted T-nuts 58 and laterally extending mating slots 62 provide for positively confining the nuts 58 in order to prevent any rotation or axial movement of the nuts 58 relatively to the base member 35 when the rail member is adjusted vertically by rotation of the screws 46.

While the form of threshold assembly herein described constitutes a preferred embodiment of the invention, it is to be understood that the invention is not limited to this precise form of assembly, and that changes may be made therein without departing from the scope and spirit of the invent ion as defined in the appended claims.

The invention having thus been described, the following is claimed:

1. A threshold assembly adapted to be installed below a bottom surface of a moveable door, comprising an elongated sill member having a sloping top surface and connected to means defining a longitudinally extending and upwardly facing cavity, an elongated rail member disposed within said cavity, means for adjusting said rail member vertically within said cavity and including a plurality of longitudinally spaced threaded fasteners rotatably supported relative to said rail member, said means defining said cavity including a longitudinally extending base member, a plurality of longitudinally spaced tubular nuts receiving said fasteners and having outwardly projecting non-circular flanges, and said base member including a corresponding plurality of longitudinally spaced and laterally extending slots receiving said nuts with said base member closely surrounding said flanges of said nuts to prevent both axial and rotary movement of said nuts in response to rotation of said fasteners to adjust the vertical height of said rail member.

2. A threshold assembly as defined in claim 1 wherein said nuts comprise die case metal nuts, and said flange of each said nut has a rectangular configuration.

3. A threshold assembly as defined in claim 1 wherein said base member comprises wood, each of said slots has an inverted T-shape cross-sectional configuration, and each of said nuts comprises an inverted T-nut.

4. A threshold assembly as defined in claim 3 and including an elongated trim member secured to said base member and forming an inner surface for said threshold assembly, and said trim member covers said laterally extending slots.

5. A threshold assembly adapted to be installed below a bottom surface of a moveable door, comprising an elongated metal sill member having a sloping top surface, a longitudinally extending wood base member under said sill member and cooperating with said sill member to define a longitudinally extending and upwardly facing cavity, an elongated rail member disposed within said cavity, means for adjusting said rail member vertically within said cavity and including a plurality of longitudinally spaced threaded fasteners rotatably supported by said rail member, a plurality of longitudinally spaced inverted T-nuts receiving said fasteners and having outwardly projecting non-circular bottom flanges, and said wood base member including a corresponding plurality of longitudinally spaced and laterally extending slots receiving said nuts with said base member closely surrounding said flanges of said nuts to prevent both axial and rotary movement of said nuts in response to rotation of said fasteners to adjust the vertical height of said rail member.

6. A threshold assembly as defined in claim 5 wherein said nuts comprise die cast metal nuts, and said flange of each said nut has a rectangular configuration.

7. A threshold assembly as defined in claim 5 and including an elongated trim member secured to said base member and forming an inner surface for said threshold assembly, and said trim member covers said laterally extending slots receiving said inverted T-nuts.

8. A threshold assembly adapted to be installed below a bottom surface of a moveable door, comprising an elongated metal sill member having a sloping top surface, a longitudinally extending wood base member under said sill member, a longitudinally extending wood trim member connected to said base member and cooperating with said sill and base members to define a longitudinally extending and upwardly facing cavity, an elongated rail member disposed within said cavity, means for adjusting said rail member vertically within said cavity and including a plurality of longitudinally spaced threaded fasteners rotatably supported by said rail member, a plurality of longitudinally spaced inverted T-nuts receiving said fasteners and having outwardly projecting rectangular bottom flanges, said wood base member including a corresponding plurality of longitudinally spaced and laterally extending slots receiving said nuts with said base member closely surrounding said flanges of said nuts to prevent both axial and rotary movement of said nuts in response to rotation of said fasteners to adjust the vertical height of said rail member, and said trim member covers said laterally extending slots receiving said inverted T-nuts.

* * * * *